US010239088B2

(12) United States Patent
Sadri et al.

(10) Patent No.: US 10,239,088 B2
(45) Date of Patent: Mar. 26, 2019

(54) FLUID APPLICATION SYSTEM ADAPTED TO COLLECT AND REUSE RECLAIMED FLUID

(71) Applicant: FORD MOTOR COMPANY, Dearborn, MI (US)

(72) Inventors: Hossein Jacob Sadri, Novi, MI (US); Stephen Juszczyk, Walled Lake, MI (US)

(73) Assignee: FORD MOTOR COMPANY, Dearborn, MI (US)

( * ) Notice: Subject to any disclaimer, the term of this patent is extended or adjusted under 35 U.S.C. 154(b) by 0 days.

(21) Appl. No.: 15/626,736

(22) Filed: Jun. 19, 2017

(65) Prior Publication Data

US 2018/0272377 A1 Sep. 27, 2018

Related U.S. Application Data

(60) Provisional application No. 62/474,904, filed on Mar. 22, 2017.

(51) Int. Cl.
*B05C 11/10* (2006.01)

(52) U.S. Cl.
CPC ..... *B05C 11/1039* (2013.01); *B05C 11/1007* (2013.01)

(58) Field of Classification Search
USPC ..... 118/308, 309, 300, 310, 666, 667, 602, 118/326
See application file for complete search history.

(56) References Cited

U.S. PATENT DOCUMENTS

| | | | | |
|---|---|---|---|---|
| 4,066,808 | A | 1/1978 | Carter | |
| 4,197,000 | A | 4/1980 | Blackwood | |
| 4,348,248 | A | 9/1982 | Poncet | |
| 4,538,542 | A | 9/1985 | Kennon et al. | |
| 4,692,028 | A | 9/1987 | Schave | |
| 4,786,060 | A | 11/1988 | Davis | |
| 5,474,609 | A * | 12/1995 | Mulder | B05B 5/032 118/308 |
| 5,505,995 | A | 4/1996 | Leonard | |
| 6,197,115 | B1 | 3/2001 | Barrey et al. | |
| 6,203,857 | B1 | 3/2001 | Patrick | |
| 9,481,008 | B2 | 11/2016 | Zolli et al. | |
| 2012/0308731 | A1 | 12/2012 | Simpson | |

(Continued)

FOREIGN PATENT DOCUMENTS

CN 101972734 2/2012

*Primary Examiner* — Yewebdar T Tadesse
(74) *Attorney, Agent, or Firm* — Ray Coppiellie; Brooks Kushman P.C.

(57) ABSTRACT

A fluid application system includes a source of a fluid and a first pump for supplying the fluid under pressure to an applicator having a nozzle for dispensing the fluid. A fluid collection system collects reclaimed fluid dispensed from the applicator and a second pump provides the reclaimed fluid under pressure to a return fluid pipe. The return fluid pipe has a valve system that selectively directs the reclaimed fluid to either a reusable fluid container or the applicator. The valve system may selectively direct the reclaimed fluid from the return fluid pipe to an in-line reservoir and a third pump may be used to provide the reclaimed fluid under pressure from the in-line reservoir to the applicator.

14 Claims, 2 Drawing Sheets

(56) References Cited

U.S. PATENT DOCUMENTS

| | | | | |
|---|---|---|---|---|
| 2012/0308732 | A1* | 12/2012 | Chiang | A63B 37/0022 427/421.1 |
| 2013/0105000 | A1* | 5/2013 | Jittu | B01F 13/1002 137/312 |
| 2013/0123975 | A1 | 5/2013 | Duckworth | |

* cited by examiner

FLUID APPLICATION SYSTEM ADAPTED TO COLLECT AND REUSE RECLAIMED FLUID

REFERENCE TO RELATED APPLICATIONS

This application claims the benefit of U.S. provisional application Ser. No. 62/474,904 filed Mar. 22, 2017, the disclosure of which is hereby incorporated in its entirety by reference herein.

TECHNICAL FIELD

The present disclosure generally relates to a fluid delivery system for applying a fluid, such as a sealer, a mastic, or an adhesive, to articles of manufacture.

BACKGROUND

Fluid materials are often applied during a manufacturing process to components of a variety of articles of manufacture. The fluid material may be a sealer, an adhesive, a sound deadener, or the like. Such fluid materials may be applied to increase the structural integrity of the vehicle, seal gaps, or join vehicle panels together.

One problem with the application of fluid material in an automated manufacturing system is that a significant volume of the material may be lost during the application process. Fluid material may be lost because of system purging, misapplication, or overspray. Supply drums must be changed over periodically when nearly empty or after an extended period of non-use that may be caused by a line change over or an interruption in a production schedule. Material remaining in the drum is considered hazardous waste that must be disposed of in accordance with appropriate procedures for handling toxic material. Disposal of reclaimed fluid material may negatively impact the environment and increases overall manufacturing costs.

This disclosure is directed to solving the above problems and other problems as summarized below.

SUMMARY

A fluid delivery system is disclosed that facilitates reclaiming fluid that is normally lost during the application process to be used later. Several embodiments of this disclosure provide significant cost savings in the overall manufacturing process, reduce or eliminate hazardous waste generation, and are more environmentally friendly.

A fluid delivery system may include a source drum of a fluid material, an applicator configured to dispense the fluid material, a fluid collection system configured to collect reclaimed fluid material dispensed from the applicator, a reusable fluid container, and in some cases, an in-line back-up reservoir. The valve system may be configured to direct fluid from the source drum of the fluid material to the applicator, or to the reusable fluid container to pump out spoiled fluid or the end of the drum. The valve system may be configured to redirect fluid material collected by the fluid collection system to an in-line reservoir supply, or the reusable fluid container. The valve system may be further configured to redirect fluid material received from the reusable fluid container to the applicator.

According to one aspect of this disclosure, a fluid application system is disclosed that includes a source of a fluid and a first pump for supplying the fluid under pressure to an applicator having a nozzle for dispensing the fluid. A fluid collection system collects reclaimed fluid dispensed from the applicator and a second pump provides the reclaimed fluid under pressure to a return fluid pipe having a valve system that selectively directs the reclaimed fluid to either a reusable fluid container or the applicator.

Per other aspects of this disclosure, the application system may further comprise an in-line reservoir into which the valve system selectively directs the reclaimed fluid from the return fluid pipe and a third pump may provide the reclaimed fluid under pressure from the in-line reservoir to the applicator.

The application system may further comprise a supply pipe supplying fluid from the source of fluid and a supply valve selectively supplying the fluid to either the applicator or the reusable fluid container to purge the source of the fluid.

The fluid may be a sealant, an adhesive, or a mastic.

The fluid collection system may include a filtration system for removing contaminants from the reclaimed fluid and may include a temperature control system for modulating the temperature and viscosity of the reclaimed fluid.

According to another aspect of this disclosure, a fluid application system is disclosed that comprises a source of a fluid and a first pump that pumps the fluid to an applicator. A collector collects reclaimed fluid dispensed by the applicator and a second pump pumps the reclaimed fluid to a return pipe having a valve system that selectively directs the reclaimed fluid to either a reusable fluid container or an in-line reservoir. A third pump may be used to pump the reclaimed fluid from the in-line reservoir to the applicator.

The fluid application system may further comprise a supply pipe supplying fluid from the source of fluid, and a supply valve receiving fluid from the supply pipe that selectively supplies the fluid to either the applicator or the reusable fluid container to purge the source of the fluid. The fluid collection system may include a filtration system for removing contaminants from the reclaimed fluid. The fluid collection system may include a temperature control system for modulating the temperature of the reclaimed fluid. The fluid collection system may include a viscosity control system for modulating the viscosity of the reclaimed fluid.

The above aspects of this disclosure and other aspects will be described below with reference to the attached drawings.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1:
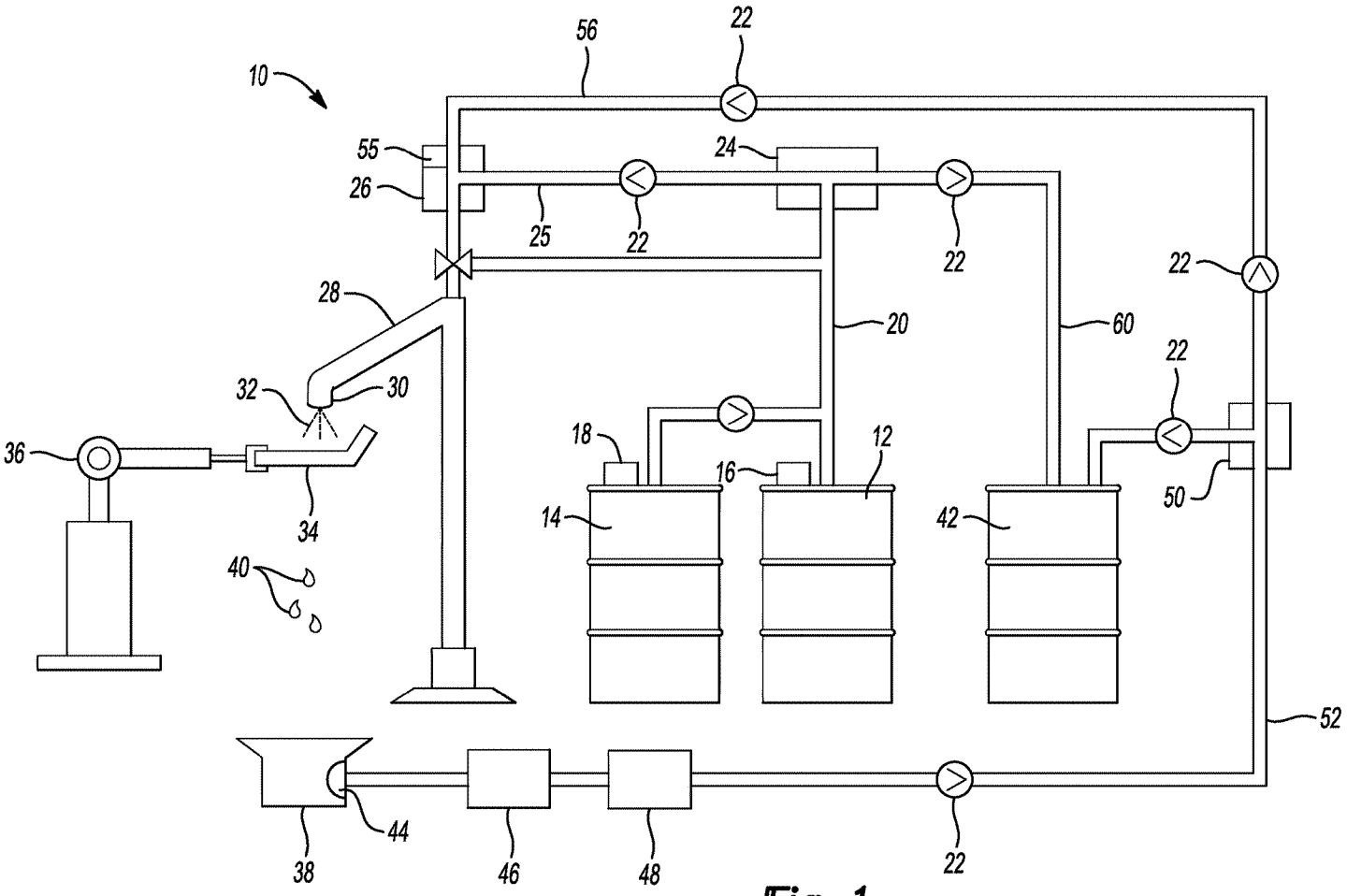
FIG. 1 is a schematic diagram of a fluid delivery system made according to one embodiment this disclosure.
Figure 2:
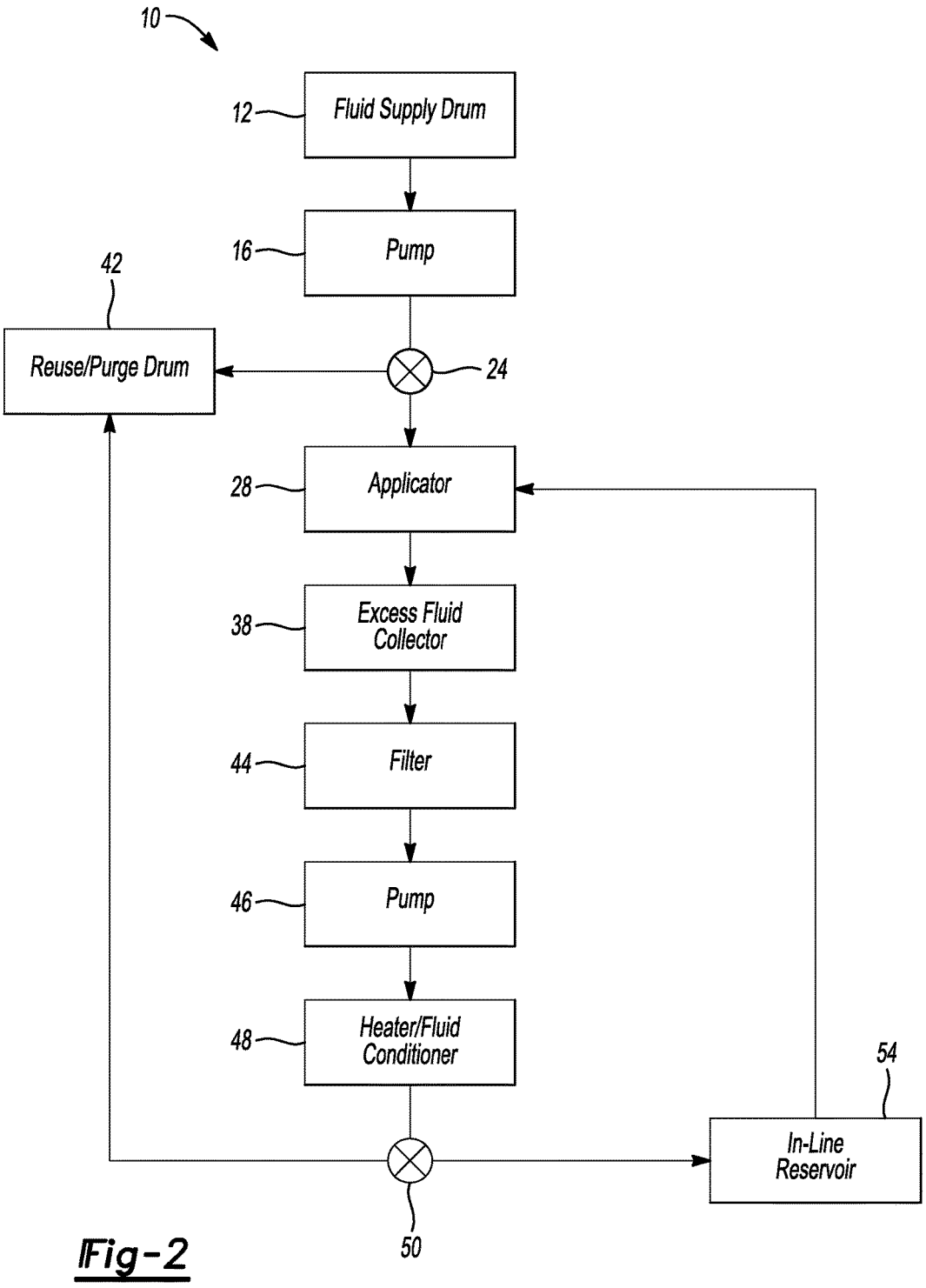
FIG. 2 is a flowchart illustrating the steps of the process for applying a fluid to an applicator, collecting and reusing or storing excess material.

Referring to FIGS. 1 and 2, a fluid application system 10 is illustrated in two different ways with FIG. 1 being a schematic representation of a manufacturing system for applying a fluid and FIG. 2 being a simplified flowchart of the system.

The fluid application system 10 includes a source of material 12, such as a drum of a sealant, adhesive, or mastic used in a manufacturing process. The system 10 may include a backup drum 14 of the fluid to ensure continued supply of the fluid to the manufacturing line. A pump 16 pumps fluid from the source of fluid 12 and a separate backup pump 18 provides fluid from the backup drum 14.

The fluid is provided through a supply pipe 20 that receives the fluid under pressure from either the pump 16 or backup pump 18. The supply pipe 20 may be pipe, tube, hose, or other type of conduit suitable for supplying the fluid. A plurality of check valves 22 are provided in the system to prevent reverse flow fluid as is well known in the art.

The fluid from the supply pipe 20 is provided to a supply valve 24. The fluid is directed by the supply valve 24 through a dispensing pipe 25, check valve 22, to an in-line reservoir 26, and to an applicator 28 that includes a nozzle 30. A fluid 32 is shown being dispensed by the nozzle onto a part 34. The part 34 is supported by a robot 36, or fixture, while the nozzle 30 dispenses the fluid 32 onto the part 34.

A fluid collector 38 is provided for returning reclaimed fluid 40 to a reusable fluid container 42, or reuse/purge drum. The fluid collector 38 is part of fluid collection system as will be more fully described below.

The reclaimed fluid 40 is filtered through a filter 44 that removes contaminates and otherwise unusable portions of the reclaimed fluid 40. A pump 46 pumps the reclaimed fluid 40 from the fluid collector 38 through the filter 44 and into a heater 48 that is used to control the viscosity of the reclaimed fluid 40. Instead of a heater 48, another type of viscosity control mechanism may be used such as mixer or cooling heat exchanger so that the reclaimed fluid 40 is either reconditioned for supplying the applicator or is stored in the reusable fluid container 42.

The fluid collection system also includes a reclaimed fluid valve 50 that may be used to direct the reclaimed fluid through a reclaimed fluid pipe 52 and to either the reusable fluid container 42 or the in-line reservoir 26. Fluid provided to the reusable fluid container 42 may be removed from the line for recycling or may be used for manual fluid application processes. Fluid directed by the reclaimed fluid valve 50 to the in-line reservoir 26 through the pipe 56 may be combined with fluid flowing from the supply valve 24 through the dispensing pipe 25 or may be held in the reservoir 26 until needed, for instance, for a change-over from the source of fluid drum to a backup drum 14. The in-line reservoir 26 may include a pump 55 for the reclaimed fluid 40 after being stored in the in-line reservoir 26. Alternatively, the reclaimed fluid 50 may be provided directly to the applicator 28 and nozzle 30.

As an alternative, the in-line reservoir 26 may be eliminated or may be provided with a bypass pipe. If the in-line reservoir 26 is eliminated, the reclaimed fluid 40 may be provided under pressure from the pump 46 directly to the dispensing pipe 25 or applicator 28. The flow of the reclaimed fluid 40 may be combined with the fluid received from the source of fluid 12 through the supply pipe 20, supply valve 24, and dispensing pipe 25.

A return line 60 may be included as part of the fluid application system 10 to allow fluid to flow from the applicator 28 and back to the supply pipe 20. A return valve 58 selectively redirects the fluid 32 from the applicator 28 to the return line 60. The return line 60 allows the fluid 32 to continuously flow through the system 10.

As the fluid 32 in the source if fluid 12 or 14 is depleted, the remaining fluid at the bottom of the drum may be pumped out through the valve 24 and the return pipe 62 to the reusable fluid container 42. The drums 12 and 14 may also be purged for other reasons such as when the line is stopped for an extended period.

Referring specifically to FIG. 2, a simplified flow diagram is provided. As shown in FIG. 2, the process begins by drawing fluid from the fluid supply drum 12 by the pump 16. The pump may be a drum pump that includes a piston that is advanced into the drum 12 to exert pressure on the fluid (shown in FIG. 1) and provide pressurized fluid to the supply valve 24. The supply valve 24 directs the fluid 32 to either the applicator 28 in normal operation, or if the drum 12 is nearly empty, the supply valve 24 may be switched to direct the fluid 32 into the reuse/purge drum 42. If operating normally, the fluid 32 is provided to the applicator 28 that applies the fluid 32 to the part as previously described with reference to FIG. 1. Any excess fluid or reclaimed fluid 40 is collected in an excess fluid collector 38. The reclaimed fluid 40 is then filtered by a filter 44. A pump 46, such as a sump pump or scavenger pump, pumps the reclaimed fluid 40 from the fluid collector 38 through the filter 44 and into a heater/fluid conditioner at 48. The conditioned reclaimed fluid 40 is directed by a reclaimed fluid valve 50 either into the in-line reservoir at 54 or directs it back to the reuse/purge drum 42.

At each stage of the process, check valves (not shown in FIG. 2) are used to limit the flow of the fluid in accordance with the above description and inhibit reverse flow of fluid.

While generally the fluid in the reuse/purge drum 42 is not used to supply the applicator, with some systems and for some fluids it may be feasible to direct the reclaimed fluid or purged fluid into the applicator. However, directly supplying from the reuse/purge drum 42 would not be a normal function of the fluid supply system 10.

The embodiments described above are specific examples that do not describe all possible forms of the disclosure. The features of the illustrated embodiments may be combined to form further embodiments of the disclosed concepts. The words used in the specification are words of description rather than limitation. The scope of the following claims is broader than the specifically disclosed embodiments and also includes modifications of the illustrated embodiments.

What is claimed is:

1. A fluid application system, comprising:

a source of a fluid;

a first pump supplying the fluid under pressure to an applicator;

a fluid collection system collects reclaimed fluid dispensed from the applicator;

a second pump providing the reclaimed fluid under pressure to a return fluid pipe having a valve system that selectively directs the reclaimed fluid to one of a reusable fluid container and the applicator;

an in-line reservoir, wherein the valve system selectively directs the reclaimed fluid to the in-line reservoir from the return fluid pipe; and a third pump directly pumps the reclaimed fluid under pressure from the in-line reservoir to the applicator.

2. The application system of claim 1 wherein the fluid is a sealant.

3. The application system of claim 1 wherein the fluid is an adhesive.

4. The application system of claim 1 wherein the fluid is a mastic.

5. The application system of claim 1 wherein the fluid collection system includes a filtration system for removing contaminants from the reclaimed fluid.

6. The application system of claim 1 wherein the fluid collection system includes a temperature control system for modulating the temperature and viscosity of the reclaimed fluid.

7. A fluid application system, comprising:

a source of a fluid;

a first pump pumping the fluid to an applicator;

a collector collects reclaimed fluid dispensed by the applicator;

a second pump pumping the reclaimed fluid to a return pipe having a valve that selectively directs the reclaimed fluid to one of a reusable fluid container and an in-line reservoir; and a third pump directly pumping the reclaimed fluid from the in-line reservoir to the applicator.

8. The fluid application system of claim 7 further comprising:

a supply pipe supplying fluid from the source of the fluid; and a supply valve receiving fluid from the supply pipe that selectively supplies the fluid to one of the applicator and the reusable fluid container to purge the source of the fluid.

9. The application system of claim 7 wherein the fluid is a sealant.

10. The application system of claim 7 wherein the fluid is an adhesive.

11. The application system of claim 7 wherein the fluid is a mastic.

12. The application system of claim 7 wherein the collector includes a filtration system for removing contaminants from the reclaimed fluid.

13. The application system of claim 7 wherein the collector includes a temperature control system for modulating the temperature of the reclaimed fluid.

14. The application system of claim 7 wherein the collector includes a viscosity control system for modulating the viscosity of the reclaimed fluid.

* * * * *